United States Patent [19]

Bjerklie

[11] 4,115,051

[45] Sep. 19, 1978

[54] RADIATION REFLECTING DOOR FOR PROCESS FURNACE

[75] Inventor: John W. Bjerklie, Cape Elizabeth, Me.

[73] Assignee: Hague International, So. Portland, Me.

[21] Appl. No.: 745,803

[22] Filed: Nov. 29, 1976

[51] Int. Cl.[2] ..... F27D 1/18; F23M 7/00

[52] U.S. Cl. ..... 432/3; 110/173 R; 110/176; 432/250

[58] Field of Search ..... 110/173 R, 176; 432/250, 243, 242, 3

[56] References Cited

U.S. PATENT DOCUMENTS

| | | | |
|---|---|---|---|
| 1,923,886 | 8/1933 | Ray | 432/242 |
| 2,316,580 | 4/1943 | Hamlink | 432/250 |
| 3,429,562 | 2/1969 | Hewlett | 432/250 |

FOREIGN PATENT DOCUMENTS

| | | | |
|---|---|---|---|
| 716,560 | 1/1942 | Fed. Rep. of Germany | 432/250 |
| 539,673 | 2/1956 | Italy | 432/250 |

*Primary Examiner*—John J. Camby

*Attorney, Agent, or Firm*—Wolf, Greenfield & Sacks

[57] ABSTRACT

A slot furnace has a radiation resistant door which can easily be opened and closed as necessary during operation. The door is mounted on a pivot so that an end thereof covered with heat resistant insulation can be pivoted to open and close the slot when desired, to allow ease of feeding and removing materials from the furnace while preventing substantial radiational heat loss during normal operations.

8 Claims, 4 Drawing Figures

RADIATION REFLECTING DOOR FOR PROCESS FURNACE

BACKGROUND OF THE INVENTION

Process furnaces such as slot furnaces are well-known for such purposes as forging ferrous materials. Such furnaces often have an elongated horizontal slot through which the material to be heated is thrust in and taken out. The furnaces often operate with internal wall temperatures of between 1500° F and 2600° F or higher. Heat loss by radiation from the slot at such high temperatures represents a large fraction of the heat supplied to the furnace. Iron and similar doors have often been used to close slots in the prior art but such materials absorb and reradiate heat to the outside affording little control over heat loss by radiation.

The radiation loss through the slot can be significant depending of course on the operating temperature, door area and perhaps other parameters. The iron door closure for conventional slot furnaces does not avoid the radiation loss problem.

SUMMARY OF THE INVENTION

It is an important object of this invention to provide a movable door for a process furnace slot which door provides a radiation resistant barrier to radiational heat loss from the furnace.

It is another object of this invention to provide a door in accordance with the preceding object which is relatively inexpensive, practical and rugged in operation allowing use over long lifetimes by common process furnace operators.

Still another object of this invention is to provide a door in accordance with the preceding objects which has particular mounting means to enable ease of opening and closing while providing mechanical ruggedness to enable ease of loading and unloading the furnace with the door acting as a hearth.

Still another object of this invention is to provide a door in accordance with the preceding object which enables significant fuel savings in process furnace operation.

According to the invention a process furnace has an exit slot. A door with a first and second end has an elongated top surface acting as a hearth for carrying work pieces and an end edge surface at the second end. The end surface is insulated with a radiation resistant insulation resistant to temperatures in the range of from 1500° F to at least 2600° F at which temperatures the furnace may be operating. A pivot between the first and second end mounts the door and is so positioned as to permit pivoting of the hearth to expose the end edge surface to the slot, and so open and close the slot when desired. Preferably the pivot is so positioned that the door is counterbalanced to a closed position and held in that position by a stop. When in the closed furnace position, work pieces can be placed on the door ready for immediate positioning in the furnace when the door is pivoted to open the slot.

Preferably the pivot means is mounted on a means for relocating the pivot axis so as to change the dimensions of the slot when desired to a predetermined opened slot size. Such adjustment would be made to suit the size of work, so that radiation loss is limited, whenever the door is open, to be no more than necessary.

It is a feature of this invention that depending upon the work pieces to be worked in the process furnace, the slot can be varied in dimension. Thus the height can be decreased if small work pieces will be used since only smaller heights may be necessary in the open position as will be described. A further feature of the invention resides in the ruggedness of the door acting as a work table for holding work pieces prior to and after removal from the process furnace.

BRIEF DESCRIPTION OF THE DRAWINGS

The above and other features, objects and advantages of the present invention will be better understood from a reading of the following specification in conjunction with the drawings in which.

DESCRIPTION OF PREFERRED EMBODIMENTS

Figure 1:
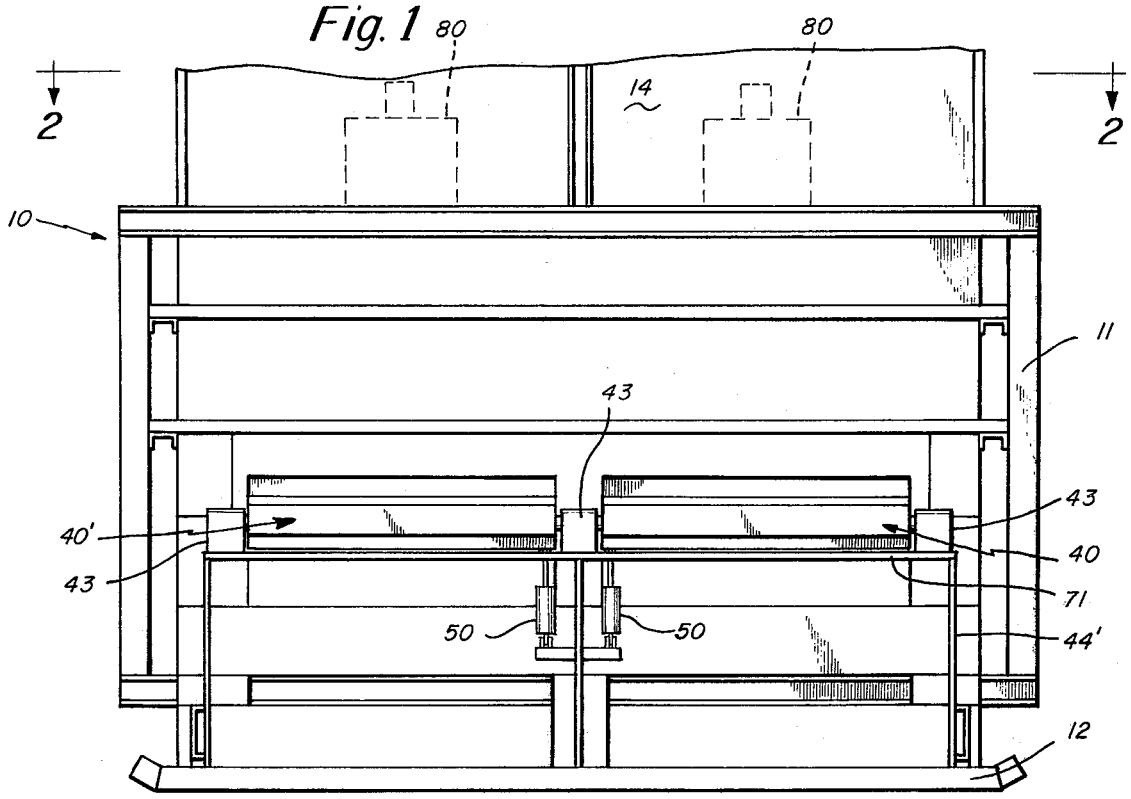
FIG. 1 is a front view of a process furnace in accordance with this invention.
Figure 2:
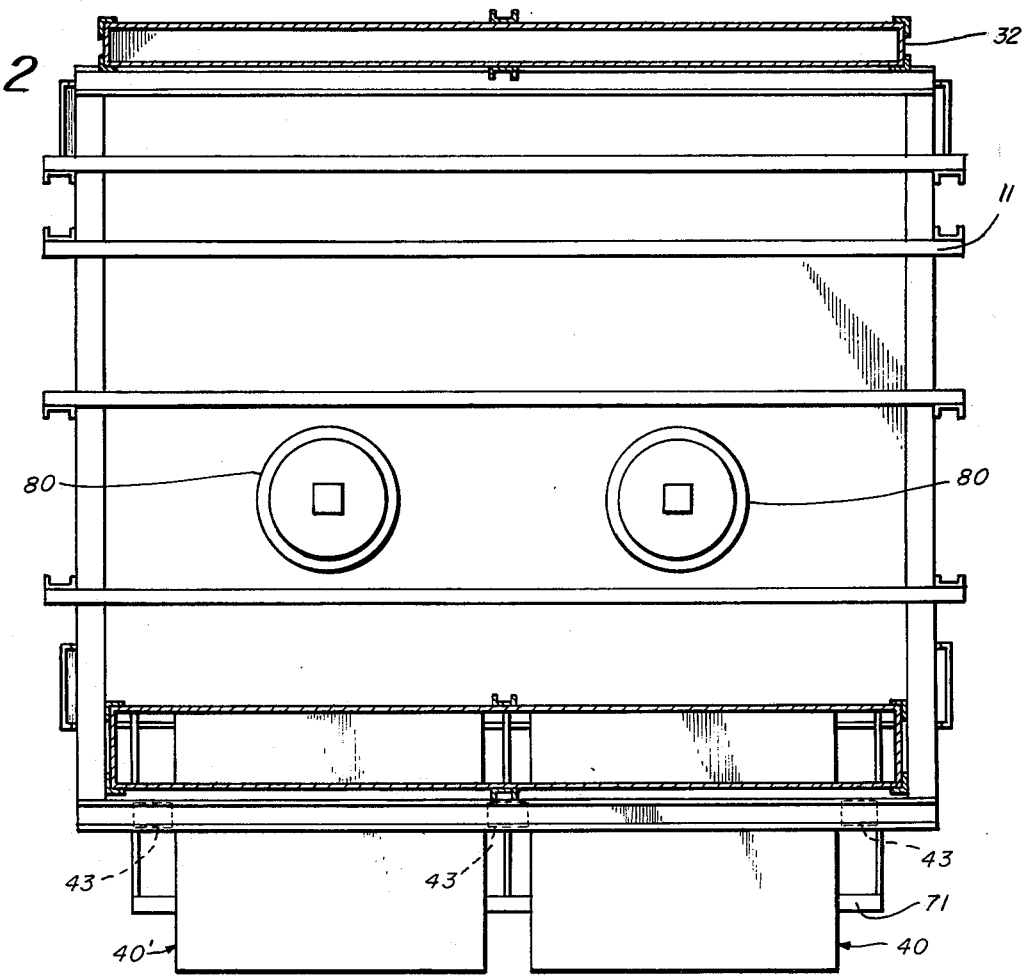
FIG. 2 is a top plan view thereof.
Figure 3:
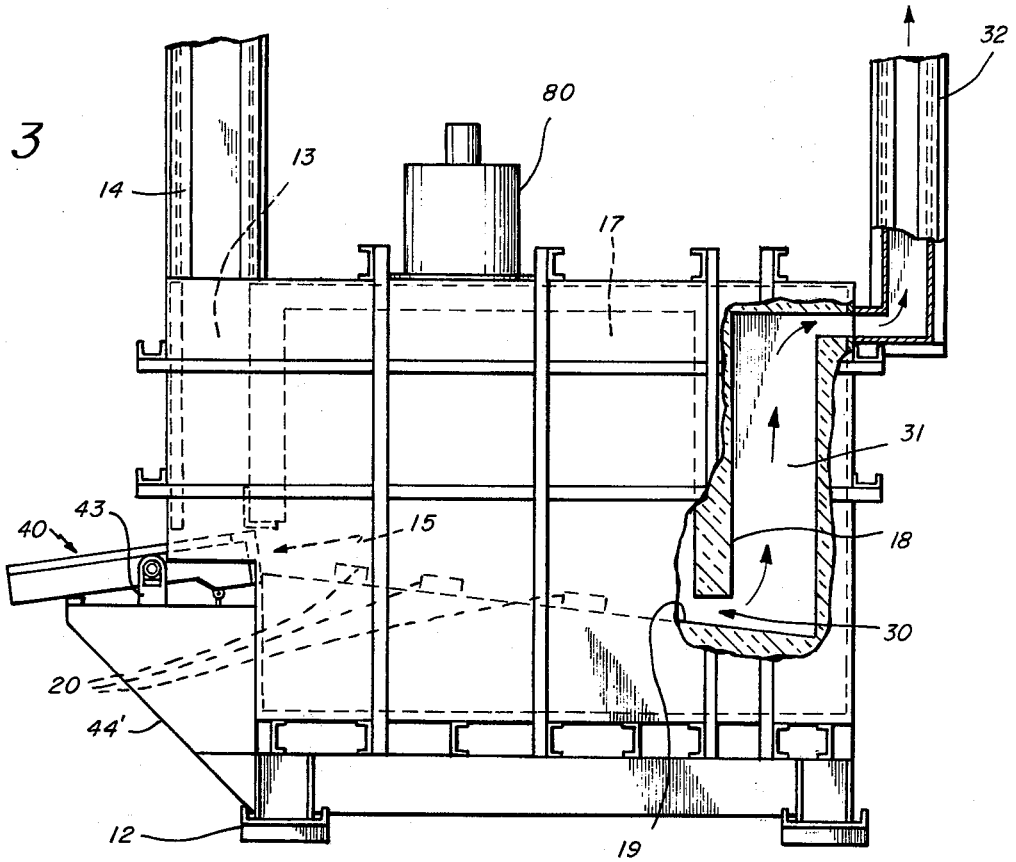
FIG. 3 is a cross sectional view thereof through line 3-3 of FIG. 2.

With reference now to the drawings a conventional slot furnace 10 is illustrated in FIGS. 1-3 with a modified door construction in accordance with this invention. The furnace 10 as known in the art is designed for forging metal pieces and is formed by a steel framework 11 standing on a base 12, with a radiation protective passageway 13, and a radiation front shield 14 for exhaust gas exiting through a slot 15 which may for example have a height of 3 inches and a length of 10 feet. A burning chamber 17 is adapted to be heated to temperatures normally in the range of from 1500° F to 2600° F and higher and is lined with high temperature resistant insulation 18 throughout as known in the art. The base 19 may be lined with fire brick or other high temperature resistant materials and has a floor designed to meet with the opening of the slot so that ingots or other material to be worked can be positioned easily therein as shown at 20. Suitable burners 80 are provided to heat the chamber 17 as known in the art.

In many prior art slot furnaces, the slot 15 is used both for entrance and exit of work product and exhaustion of the products of combustion as through passageway 13. However, it is preferred that a slot outlet be provided for exhaust gases as at 30 with the exhaust gas flow 31 being passed to a recuperator arrangement not shown for recouping heat which would otherwise be lost, or alternatively to the atmosphere through the exhaust 32.

The doors of this invention can be used in common slot furnaces which normally have horizontal slots with heights of from 2 to 8 inches or higher and lengths of from 2 to 10 feet and above. Combustion chamber areas are often within the range of 3.3 to 160 cubic feet or higher. Slot furnace 10 has a combustion chamber with dimensions of 39 × 110 × 35 and a slot with a height of 3 to 6 inches and a width of 110 inches with two side by side doors each having a width of 53 inches, a length of 27 inches and an edge surface 45 height of 6 inches. The doors can be spaced apart a distance of 4 inches. In some cases the space in the slot between the door edges when more than one door is used, can be blocked with head radiation resistant material.

The improved door of this invention is illustrated generally at 40 and is balanced on a horizontally extending shaft 41 pivoted in side bearings 42 mounted on a bracket 43 welded or otherwise secured to an extension 44' from the main frame 11 of the slot furnace. The bearing and support structures on each side of the door are identical. The door itself has a first end 44 and an inner end edge surface 45. A top surface 46 is covered in part by a durable mechanically resistant abrasion resistant surface which may for example be formed of high temperature resistant steel or silicon carbide. This surface acts to support work pieces before and after removal from the forging area and thus must be resistant to abrasion. In those cases where it will be used for supporting materials after removal, it is preferred that silicon carbide or other high temperature resistant material be used and that a backing of high temperature resistant insulation be used under that surface. For example, when the top surface 46 is formed of stainless steel, silicon carbide or alumina, having thicknesses of for example ½ to 1½ inches, a high temperature lightweight insulation such as Fiberfrax HT (made by Carborundum Co. of Niagara Falls, N.Y.) having an insulation value of 0.5 BTU/ft$^2$/°F/in. in a two-inch thick layer can underlie the surface to provide desired insulation. The sides and bottom layer 47 in that case can be steel. Lightweight, higher insulating materials of greater rigidity can also be used, such as FC-25 (castable Fiberfrax), A.P. Green Co. Castable 22, and the like.

The inner surface 45 preferably has an L-shaped or cap-shaped surfacing material which may be at least an inch or more thick and formed of a radiation resistant material which will not break down at high temperatures and acts as an effective barrier to radiation loss from the heated area. Thus end 45 can be formed of such high temperature resistant materials as silicon carbide or alumina.

An air cylinder 50 is mounted on the frame with its piston 51 operable when raised to close the slot by moving the door to the dotted outline position 52 and open the slot by moving the door to the full line position shown where the door is opened. The door can be opened and closed manually, electrically, hydraulically or pneumatically as may be desired. When the cylinder 50 is not operating, the door is preferably balanced as shown so as to move to the 52 position automatically to automatically close the furnace.

Preferably the door 40 is but one door of an elongated slot with several doors such as 40 and 40' employed in order to enable opening only a single portion along the length of the slot if only a portion is necessary to remove or introduce materials into the work area.

Figure 4:
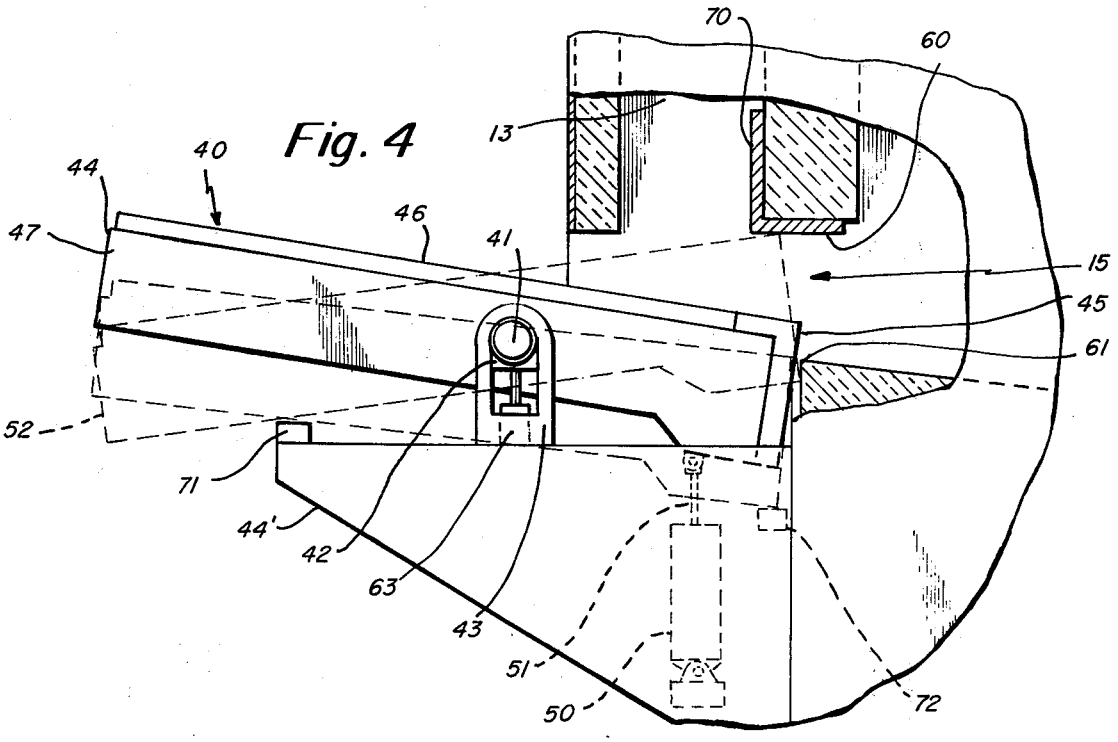
FIG. 4 is an enlarged detail showing the preferred embodiment of the door of this invention.

The pivot shaft 41 can be fixed in position or movable in a vertical plane to raise or lower the door. Thus, as shown in FIG. 4, the slot height from point 60 to point 61 is effectively reduced even when the door is in the open position since the pivot point 41 is raised slightly. When an air cylinder 63 is activated to lower each of the side pivot bearings 42, the open position of the door can have the top surface 46 substantially even with edge 61 to provide a larger slot for introduction and removal of larger work pieces. In some cases, cylinders such as 63 or other moving means for movement of the pivot axis in a vertical plane, need not be used where the furnaces are conventionally used for substantially similar work pieces.

Preferably each door used in slot furnaces has widths of from 2 to 4 feet so as to allow a substantial portion of the slot to be closed at all times even though some work is being introduced or removed from the chamber through a single door of the furnace.

Stops are provided for the door in both the open and closed position. For example, the angle iron 70 can act as a closed position stop for the door and the door cannot move beyond stop 70. However, the closed position stop is preferably a bar 71 supported on the frame extension 44' so as to prevent further movement beyond the closed position when the door rests on the stop as in the dotted line position shown at 52. A stop for the opened position is provided on the frame as illustrated at 72. The stop can be adjustable along with the pivot.

The door is in effect a balance table supported on an axis by a shaft or pins which allow the front edge of the table to be tilted into the slot when access is not required. The top of the table is used as a rest for work pieces to be loaded through the slot.

The end edge 45 of the door is preferably faced with a thin, mechanically tough ceramic or other mechanically strong high temperature resistant material such as alumina which can be backed up with an even better high temperature insulating material such as Fiberfrax. Such combination assures that the door edge gets very hot very rapidly when moved into the slot as the door is closed thus absorbing little heat so as to represent little loss. The hot thin surface acts as a "radiation resistant" layer, i.e., the surface is reflective to heat waves in the infrared range.

Access to the furnace can be obtained quickly by moving the door outer edge upwardly by a rocking motion of the table about the axis until the slot between the top of the table and the bottom of the furnace slot is large enough for the work piece and the handling tongs to pass through.

As compared with conventional slot furnaces, typical savings in fuel consumption by using the doors of this invention can be in the 15 to 35% range depending upon what fraction of the time the door is closed.

Particularly when used with other energy saving features such as recuperators, efficient burners and the like, the doors of this invention can have significant fuel saving consequences.

While a particular embodiment of this invention has been shown and described, many variations are possible. The furnaces may vary in size greatly as may the size and number of slots used. The table-like arrangement of the door enables it to act as both a work surface and a closure. While it is preferred that the door be used in connection with a furnace having an exhaust slot at another location than the slot, in some cases, the door can be used where the slot is used as is the combustion gas exhaust. In those cases, the door may be arranged to close only partially rather than fully if desired.

It should be noted that the door of this invention can be opened and closed quickly with a minimum of effort. The doors are convenient to use and not subject to vibration or large magnitudes since one moves the doors over only small angles. Preferably the angles of movement of the door are ±9½° from a horizontal plane so that work can be supported on the door at all times. Only a small part of the door is subject to very high temperatures.

In some cases the pivot of the door can be closer to the outside edge of the door than in the preferred embodiment as where short length doors may be desired.

A large variety of insulating materials and construction materials can be used as will be apparent in those skilled in the art.

What is claimed is:

1. A process furnace having an exit slot, a door for said slot having first and second ends and an elongated top surface with an end edge surface at said second end, said end edge surface being insulated with a radiation resistant insulation resistant to temperatures in the range of from 1500° F to at least 2600° F at which temperatures said furnace may be operated, a moving means mounting said door between said first and second ends and positioned to permit moving of said end edge surface to open and close said slot with said insulation forming an insulation barrier for said slot when said slot is closed, said slot being horizontally arranged and said door lying in a horizontal plane, said moving means comprising a pivot, said pivot comprising a horizontal axis located parallel to an elongated axis of said slot, said door defining a work supporting surface for supporting work pieces prior to and after heating to temperature in said furnace, stop means for determining at least one position of said door.

2. A process furnace in accordance with claim 1 wherein said door second end is positioned closer to said pivot axis than said door first end so that said door second end is constantly biased to an up position.

3. A process furnace in accordance with claim 1 wherein said slot has a height of from 2 to 8 inches and a length of from 2 to 15 feet.

said door having a width less than the width of said slot and a second door positioned in line with said first door to close a portion of said slot not closed by said first door.

4. A process furnace in accordance with claim 3 and further comprising said furnace having a combustion chamber area in the range of from about 3.3 cubic feet to about 160 cubic feet and having burner means therein capable of heating said furnace to temperatures in the range of from 1500° F to 2600° F.

a heat radiation shield positioned above and forwardly of said slot, and exhaust gas means from said furnace located at a position spaced from said slot.

5. A process furnace in accordance with claim 4 wherein said pivot is provided by a horizontal shaft, and means for vertically changing the position of said horizontal shaft to vary the maximum height of said slot opening.

6. A process furnace in accordance with claim 4 and further comprising, mechanical means for moving said door to an open and closed position of said slot.

7. A process furnace in accordance with claim 1 wherein said door is pivotal about said horizontal axis through an angle no more than ±9½° from a horizontal plane.

8. A method of opening and closing a horizontal slot of a metal processing slot furnace by, mounting a door in a substantially horizontal plane about a pivotal axis parallel to an elongated axis of said slot, pivoting said door through angles of from ±9-½° from a horizontal plane to open and close said door and using a portion of said door as a work holding platform when said door is opened and when it is closed, with another portion of said door acting to open or close said slot as may be desired.

* * * * *